US011576429B2

(12) United States Patent
Knight et al.

(10) Patent No.: US 11,576,429 B2
(45) Date of Patent: Feb. 14, 2023

(54) FLAVOUR SYSTEM

(71) Applicant: British American Tobacco (Investments) Limited, London (GB)

(72) Inventors: Matthew Knight, London (GB); Ianto Davies, London (GB); Alex Renouf, London (GB); Aaron Brookbank, London (GB); Ignacio Suarez Yanez, London (GB); Karl Fellbrich, London (GB)

(73) Assignee: BRITISH AMERICAN TOBACCO (INVESTMENTS) LIMITED, London (GB)

( * ) Notice: Subject to any disclaimer, the term of this patent is extended or adjusted under 35 U.S.C. 154(b) by 304 days.

(21) Appl. No.: 16/638,654

(22) PCT Filed: Aug. 15, 2018

(86) PCT No.: PCT/GB2018/052316
§ 371 (c)(1),
(2) Date: Feb. 12, 2020

(87) PCT Pub. No.: WO2019/034872
PCT Pub. Date: Feb. 21, 2019

(65) Prior Publication Data

US 2021/0127732 A1 May 6, 2021

(30) Foreign Application Priority Data

Aug. 16, 2017 (GB) ..... 1713129

(51) Int. Cl.
*A24B 15/30* (2006.01)
*A24D 3/04* (2006.01)
(Continued)

(52) U.S. Cl.
CPC ..... *A24D 3/048* (2013.01); *A24B 15/303* (2013.01); *A24D 3/061* (2013.01); *A24D 3/14* (2013.01)

(58) Field of Classification Search
None
See application file for complete search history.

(56) References Cited

U.S. PATENT DOCUMENTS 4,273,142 A 6/1981 Swanson
7,243,659 B1 7/2007 Lecoultre
(Continued)

FOREIGN PATENT DOCUMENTS

CN 1100612 A 3/1995
EP 2730181 A1 5/2014
(Continued)

OTHER PUBLICATIONS

Oetjen, Freeze-Drying,Encycl. of Sep. Sci., pp. 1023-1043,2000,[online],retr. from Internet,[retr.Feb. 23, 2022],,<URL:https://reader.elsevier.com/reader/sd/pii/B0122267702055915?token=39AC54170109CBC44DE750C715B16AD156F7EBEF839ACC88AC49D83EA2F6C63373A9D07DF136C9651D5F6484F452A659&originRegion=us-east- (Year: 2000).*
(Continued)

*Primary Examiner* — Dennis R Cordray
(74) *Attorney, Agent, or Firm* — Cantor Colburn LLP

(57) ABSTRACT

There is provided a flavour system for use in a tobacco industry product. The flavour system comprises lyophilised botanical material, an activator capable of releasing flavourant from the lyophilised botanical material through contact of the activator with the lyophilised botanical material, and a removable barrier preventing contact between the lyophilised botanical material and the activator. The barrier is
(Continued)

removable to permit the activator to contact the lyophilised botanical material, thereby to cause release of the flavourant.

13 Claims, 3 Drawing Sheets

(51) Int. Cl.
*A24D 3/06* (2006.01)
*A24D 3/14* (2006.01)

(56) References Cited

U.S. PATENT DOCUMENTS

| | | | | |
|---|---|---|---|---|
| 2008/0173320 | A1 | 7/2008 | Dunlap | |
| 2009/0014017 | A1 | 1/2009 | Enslin | |
| 2012/0024306 | A1* | 2/2012 | Mishra | A24D 3/08 131/332 |
| 2012/0255569 | A1 | 10/2012 | Beard | |
| 2014/0182614 | A1* | 7/2014 | Nicholls | A24D 3/061 131/352 |
| 2014/0202479 | A1* | 7/2014 | Nicholls | A24D 3/048 131/337 |
| 2014/0261475 | A1 | 9/2014 | Kizer | |
| 2014/0299135 | A1 | 10/2014 | Besso | |
| 2014/0311508 | A1 | 10/2014 | Besso | |
| 2015/0027477 | A1 | 1/2015 | Yoshino | |

FOREIGN PATENT DOCUMENTS

| | | | |
|---|---|---|---|
| GB | 1065204 | | 4/1967 |
| JP | 2012200196 | A | 10/2012 |
| WO | 8202820 | A1 | 9/1982 |
| WO | 2009015142 | A2 | 1/2009 |
| WO | 2012156689 | A2 | 11/2012 |
| WO | 2012156695 | A1 | 11/2012 |
| WO | 2012156699 | A1 | 11/2012 |
| WO | 2014012841 | A2 | 1/2014 |
| WO | 2014023557 | A1 | 2/2014 |
| WO | 2015091792 | A1 | 6/2015 |
| WO | 2015113697 | A1 | 8/2015 |

OTHER PUBLICATIONS

Continued from U—1&originCreation=20220223132926>. (Year: 2000).*

10 Differences Between Freeze Dried and Dehydrated Food, dehydratorlab..com, 2017, [online], retrieved from the Internet, [retrieved Feb. 22, 2022],<URL:https://dehydratorlab.com/freeze-dried-vs-dehydrated-foods>. (Year: 2017).*

International Preliminary Report on Patentability for corresponding application PCT/GB2018/052316 filed Aug. 15, 2018; dated Oct. 10, 2018.

International Search Report for corresponding application PCT/GB2018/052316 filed Aug. 15, 2018; dated Oct. 10, 2018.

Response to the second Written Opinion of the International Searching Authority dated Jul. 19, 2019.

Written Opinion for corresponding application PCT/GB2018/052316 filed Aug. 15, 2018; dated Oct. 10, 2018.

* cited by examiner

FLAVOUR SYSTEM

TECHNICAL FIELD

The present invention relates to a flavour system for use in a tobacco industry product and tobacco industry products incorporating flavour systems.

BACKGROUND

Tobacco industry products may comprise a flavour system. The flavour system may be arranged, for example, to provide a flavourant to the tobacco industry product.

SUMMARY

In accordance with a first aspect of the invention, there is provided a flavour system for use in a tobacco industry product. The flavour system comprises lyophilised botanical material, an activator capable of releasing flavourant from the lyophilised botanical material through contact of the activator with the lyophilised botanical material, and a removable barrier preventing contact between the lyophilised botanical material and the activator. The barrier is removable to permit the activator to contact the lyophilised botanical material, thereby to cause release of the flavourant from the lyophilised botanical material.

In accordance with a second aspect of the invention, there is provided a method for forming a tobacco industry product comprising a flavour system. The method comprises:

i) providing a flavour system including lyophilised botanical material, an activator capable of releasing flavourant from the lyophilised botanical material, and a removable barrier preventing contact between the lyophilised botanical material and the activator; and, ii) including the flavour system in a tobacco industry product.

In accordance with a third aspect of the invention, there is provided a method for forming a smoking article filter section comprising a flavour system. The method comprises:

i) providing lyophilised botanical material;

ii) providing an activator release component comprising an activator capable of releasing flavourant from the lyophilised botanical material; and, iii) incorporating the lyophilised botanical material and activator release component into a filter section.

BRIEF DESCRIPTION OF THE DRAWINGS

Embodiments of the invention will now be described, by way of example only, with reference to the accompanying drawings, in which.

DETAILED DESCRIPTION

Figure 1:
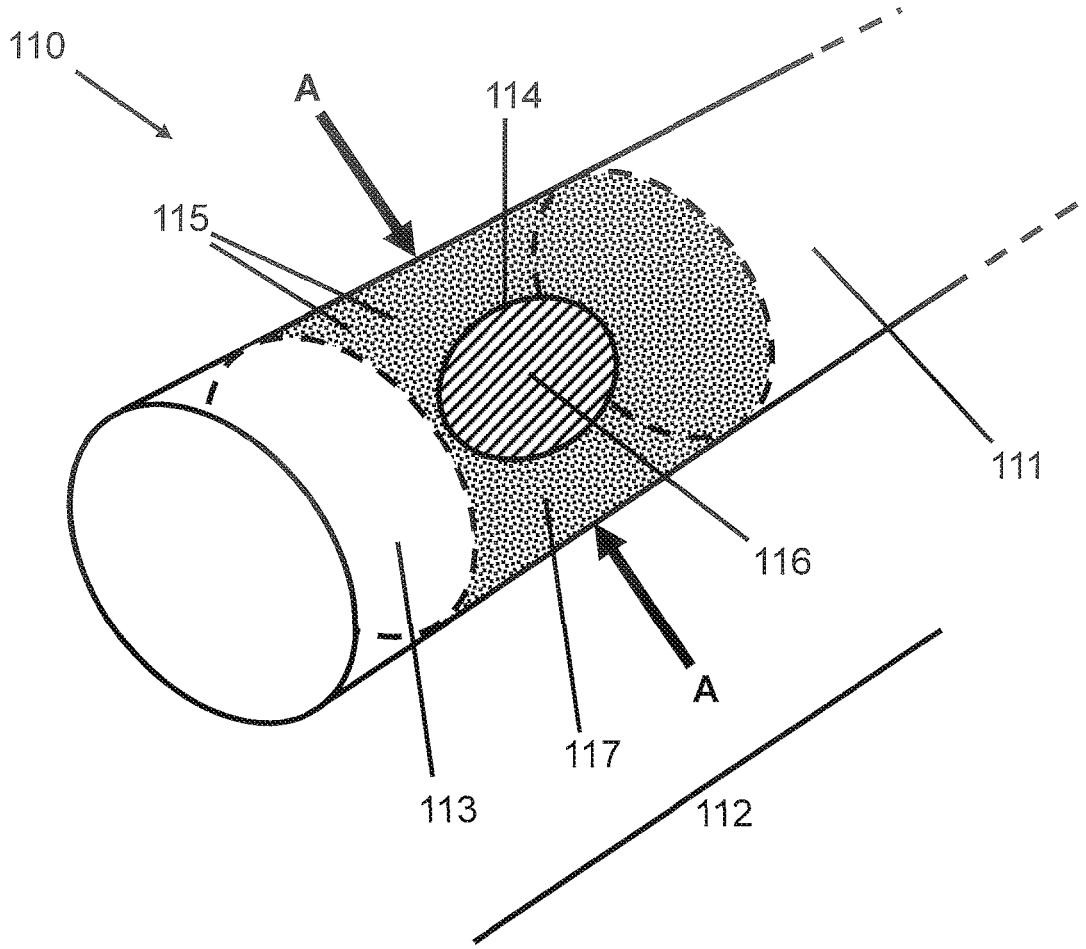
FIG. 1 shows a tobacco industry product, which is a smoking article, comprising a flavour system in accordance with a first embodiment.

FIG. 1 shows a tobacco industry product which is a smoking article 110.

The smoking article no comprises a cylindrical rod of smokeable material 111, in this case tobacco, and a filter 112. The filter 112 comprises two longitudinally aligned substantially cylindrical filter sections, which are a mouth end filter section 113, and a flavour system filter section 117. The two filter sections comprise plugs of fibrous filter material, in this case comprising cellulose acetate tow, and are circumscribed by a plugwrap (not shown).

The rod of smokeable material 111 is aligned with the filter 112 such that the end of the smokeable material rod 111 abuts the end of the filter 112. Specifically, the rod in abuts the end of the flavour system filter section 117. The rod of smokeable material 111 is wrapped in a paper wrapper (not shown), and is joined to the filter 112 using tipping paper (not shown).

The flavour system filter section 117 comprises lyophilised botanical material 115. In the embodiment shown in FIG. 1, the lyophilised botanical material 115 comprises particles of lyophilised clove material, wherein the particles are substantially evenly distributed throughout the filter material, in the form of a "Dalmatian" filter section.

The flavour system filter section 117 also comprises an activator 116, which in this case is water. The activator is contained within an activator release component 114, which functions as a removable barrier to separate the activator from the lyophilised botanical material 115 in the surrounding filter material. The activator release component 114 comprises an inner volume containing the activator 116, and an outer wall that is impermeable to the activator.

The activator release component 114 shown in FIG. 1 has an elongated or elliptical shape and is situated substantially within the centre of the flavour system filter section 117, with the longitudinal axis of the activator release component 114 corresponding to the longitudinal axis of the filter 112. In other embodiments, the activator release component 114 may be any other shape, such as spherical. In some embodiments, the flavour system filter section 117 may comprise a plurality of activator release components 114, each containing the same or different activators 116.

In the embodiment shown, the activator release component 114 is held in position within the flavour system filter section 117 due to being positioned substantially within the centre of the plug of fibrous filter material.

In all embodiments, the combination of the activator 116 and the lyophilised botanical material 115 is selected so that the activator 116 releases flavourant from the lyophilised botanical material 115. For example, the activator 116, which may be water or another flavourless solvent such as an organic solvent, may release flavourant from the lyophilised botanical material 115 by rehydrating the lyophilised botanical material 115.

When desired, such as immediately prior to, or during, use of the smoking article 110, the activator release component 114 may be actuated by the user. The activator release component 114 is arranged so that in use, the user may actuate the activator release component 114 to release at least a portion of the activator 116 into the filter material of the flavour system filter section 117. In this way, the activator 116 may be caused by the user to contact the lyophilised botanical material 115, to release flavourant from the lyophilised botanical material.

In the embodiment shown in FIG. 1, the activator release component 114 is a frangible capsule which is actuated by being ruptured in response to compressive force exerted laterally on the filter 112 in the region of the activator release component 114, for example, as indicated by the arrows A. The force may be applied, for example, by the user squeezing the filter 112 between two fingers. Rupture of the activator release component 114 removes the barrier separating the activator and lyophilised botanical material and releases the activator 116 into the surrounding filter material, which contains the lyophilised botanical material 115. The activator thus contacts the lyophilised botanical material 115 and releases flavourant from the lyophilised botanical material 115. In the embodiment shown, the activator 116, which in the embodiment shown is water, acts to release flavourant from the lyophilised botanical material 115, which in this embodiment is lyophilised clove material, by rehydrating the lyophilised clove material.

When the smoking article 110 is in use, smoke from the combustion of the rod of smokeable material 111 may be drawn through the filter 112 by the user. Flavourant released from the botanical material 115 by the activator 116 may be entrained in the smoke drawn by the user through the flavour system filter section 117, thereby altering the flavour of the smoke.

In some embodiments, the moisture content of the smoke that is drawn by the user through the filter 112 may assist the activator 116 to release flavourant from the lyophilised botanical material 115. Generally, however, the moisture content of the smoke is not sufficient to release flavourant from the lyophilised botanical material 115. Specifically, the moisture content of the smoke is too low to release sufficient flavourant from the lyophilised botanical material to cause the smoke that is drawn through the filter by the user to be flavoured to a detectable level. For at least this reason, lyophilised botanical material has not previously been included in flavour systems for use in tobacco industry products, such as smoking article filter sections.

Figure 2:
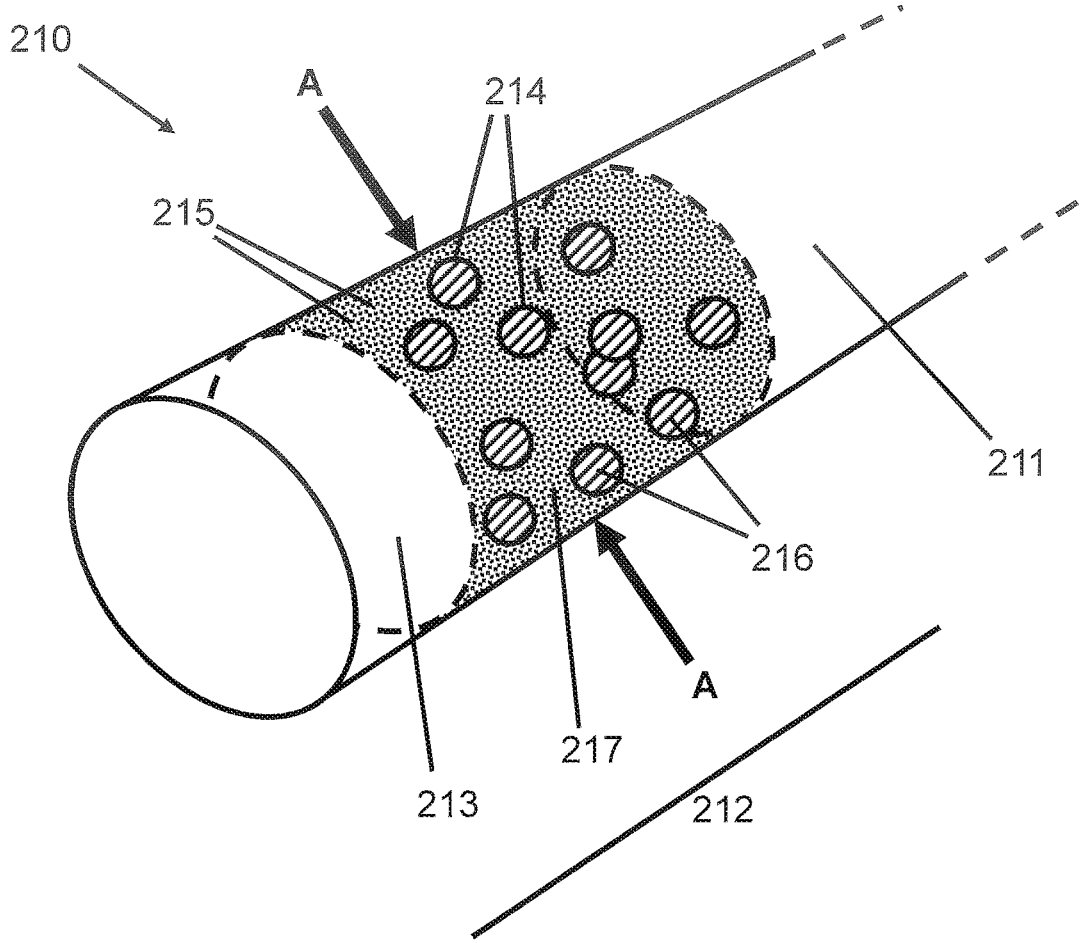
FIG. 2 shows a tobacco industry product, which is a smoking article, comprising a flavour system in accordance with a second embodiment.

FIG. 2 shows a smoking article 210 which is similar to that shown in FIG. 1 and corresponding components are indicated using reference numerals with the same last two digits. The embodiment shown in FIG. 2 differs from that of FIG. 1 primarily in that the flavour system filter section 217 comprises a plurality of separate activator release components 214. As in the embodiment of FIG. 1, the activator release components 214 are positioned within the filter material of the flavour system filter section 217. Each of the activator release components 214 comprises a frangible capsule containing an activator 216 in the form of water. The frangible capsule forms a removable barrier between the activator and the lyophilised botanical material. As in the embodiment shown in FIG. 1, the flavour system filter section 217 is in the form of a Dalmatian filter section, in which the lyophilised botanical material 215 comprises particles of lyophilised myrtle distributed throughout the filter material.

Application of force to the filter 212, for example, in the direction indicated by the arrows A, causes rupture of one or more of the activator release components 214, removing the barrier between the activator and the lyophilised botanical material, and releasing the contained activator 216 into the surrounding filter material. A small force applied to the filter 212 may rupture a single activator release component 214 in the flavour system filter section 217 and thus release a small amount of activator 216 into the surrounding filter material. In contrast, a large force applied to the filter 212 may cause the rupture of all, or substantially all, of the activator release components 214 in the flavour system filter section 217, and thus the release of a much larger amount of activator. In some embodiments, the application of a force of intermediate level to the filter 212 may cause the rupture of a proportion (such as, for example, a quarter, a half, or three quarters) of the activator release components 214 in the flavour system filter section 217. In this way, the flavour system may be arranged so that the amount of activator released into the filter material is substantially proportional to the magnitude of the force applied to the filter 212, in respect of the first application of pressure to the filter at least.

The activator 216 that is released as a result of the rupture of one or more of the activator release components 214 is then able to contact, and release flavourant from, the lyophilised botanical material 215. The greater the number of activator release components 214 that are ruptured, the greater the proportion of lyophilised botanical material 215 that is contacted by activator 216, and thus the greater the total amount of flavourant released. In this way, the user is able to control the degree of flavourant released from the lyophilised botanical material 215 by applying different levels of force to the filter 212.

A plurality of separate applications of force may be used to cause the rupture of all of the activator release components 214 and thus the release of all of the flavourant.

In the embodiment shown, both the lyophilised botanical material 215 and the activator release components 214 are arranged in a substantially even distribution throughout the flavour system filter section 217. As a result, the activator 216 that is released from each activator release component 214 into the surrounding filter material will contact and thereby release flavourant from a unique portion of the lyophilised botanical material 215.

In some embodiments, the filter may comprise more than two filter sections, such as three, four, or five filter sections. For example, in addition to the mouth end and flavour system filter sections shown in FIGS. 1 and 2, the filter may comprise, one, two, three, or more, further filter sections. In some embodiments, the filter may comprise a plurality of flavour system filter sections, each of which may be similar to any of those shown in the accompanying Figures.

Figure 3:
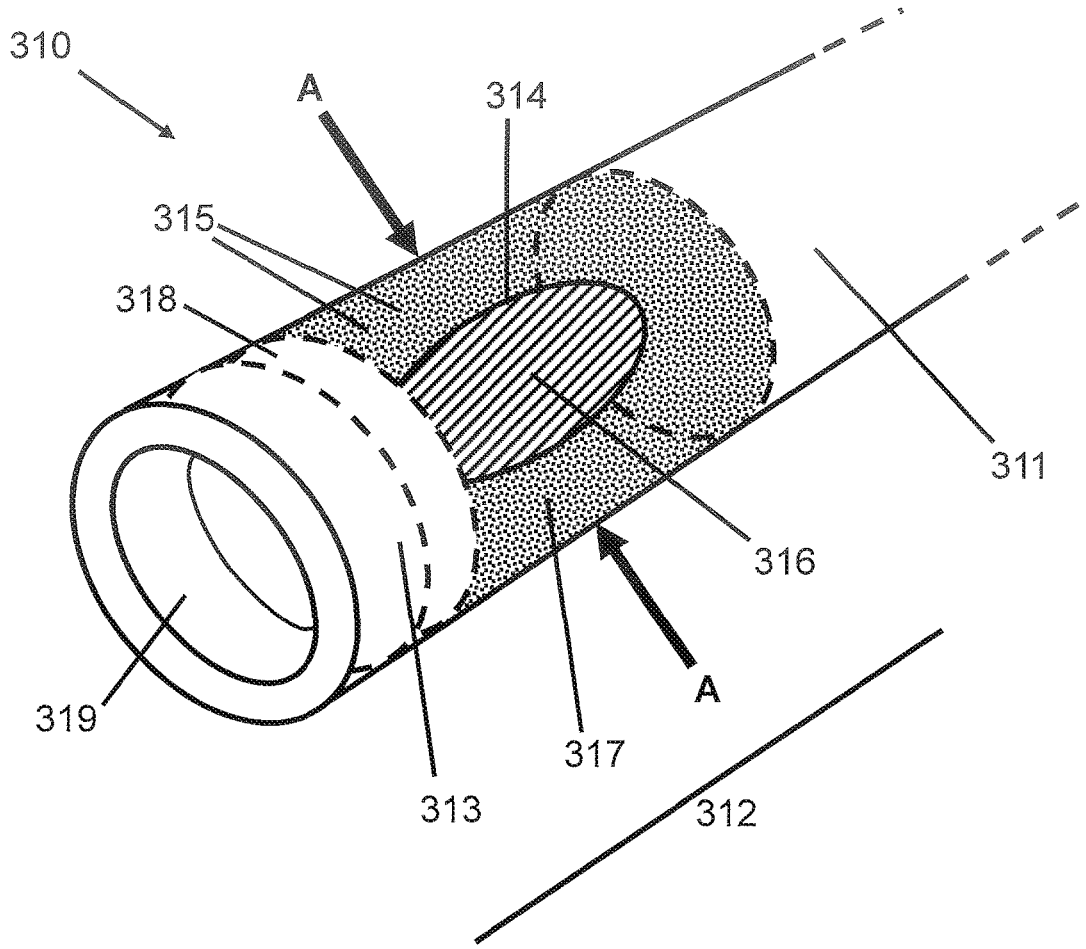
FIG. 3 shows a tobacco industry product, which is a smoking article, comprising a flavour system in accordance with a third embodiment.

FIG. 3 shows a smoking article 310 comprising a filter 312 which includes three filter sections. The smoking article is similar to that shown in FIGS. 1 and 2, and corresponding components are indicated using reference numerals with the same last two digits.

In the embodiment shown in FIG. 3, the filter 312 comprises three longitudinally aligned substantially cylindrical filter sections, which are a mouth end filter section 313, a central filter section 318, and a flavour system filter section 317. The mouth end filter section 313 is an annular filter section comprising a hollow central cavity 319. All three of the filter sections comprise fibrous filter material, in this case comprising cellulose acetate tow, and are circumscribed by a plugwrap (not shown).

The flavour system filter section 317 is the filter section closest to the rod of smokeable material 311, and comprises a Dalmatian filter section in which particles of lyophilised botanical material 315 are distributed throughout the filter material. In the embodiment shown, the lyophilised botanical material is lyophilised mint leaf material. The flavour system filter section 317 also comprises, substantially in the centre of the filter section, an activator release component 314 which is a multiple release component, configured to release activator, in this water, in a plurality of discrete deliveries. In the embodiment shown, the activator release component 314 is composed of an elastic material which is resiliently deformable and arranged to release at least three separate deliveries of activator 316 into the surrounding filter material in response to separate applications of activating force. Application of force to the filter 312, for example in the direction indicated by the arrows A, causes the release of activator 316 through one or more valves (not shown) in the wall of the activator release component 314 into the surrounding filter material, thus removing the barrier separating the activator from the botanical material. Until the activator release component is empty, each subsequent application of force to the filter 312 causes a further release of activator 316 from the activator release component 314 into the surrounding filter material.

The activator 316 that is released from the activator release component 314 is able to contact the lyophilised botanical material 315, and release flavourant from the lyophilised botanical material 315. Specifically, in the embodiment shown, the activator 316, which is water, releases flavourant from. the lyophilised botanical material 15, which is lyophilised mint leaf material, by rehydrating the lyophilised botanical material, releasing mint flavourant. Each subsequent release of activator 316 from the activator release component 314 may further hydrate the botanical material 315, and/or hydrate additional lyophilised botanical material that has not previously been contacted by the activator. Thus, in use, additional flavourant may be released from the lyophilised botanical material in response to each of a plurality of individual actuations of the activator release component 314. This advantageously allows the user to control the amount of flavourant that is released from the lyophilised botanical material and, therefore, the level of flavourant entrained in the smoke that is, in use, drawn by the user through the filter.

Lyophilised Botanical Material

The disclosed flavour system for use in a tobacco industry product comprises lyophilised botanical material. In use, flavourant is released from the lyophilised botanical material by an activator. Thus, prior to, or during, use of the tobacco industry product containing the flavour system, the user may cause the activator to contact the lyophilised botanical material and release flavourant from the lyophilised botanical material. In this way, the user may control the flavour provided by the tobacco industry product.

The lyophilised botanical material releases flavourant when contacted by an activator. The term "releases flavourant" and similar terms refer to the capacity of the activator to convert the lyophilised botanical material from a material having little or substantially no perceivable flavour when used in a tobacco industry product, to a material providing a level of flavourant that is sufficient to be readily or strongly perceived by the user. For example, flavourant substances that are retained, or otherwise "locked up" within the botanical material prior to contact with the activator may, as a result of contact with the activator, become capable of diffusing from the botanical material. In some embodiments, the lyophilised botanical material releases no flavourant prior to being contacted by the activator. In other embodiments, the lyophilised botanical material releases a degree of flavourant prior to being contacted by the activator, and the activator causes an increase, preferably a substantial increase, in the amount of flavourant released.

The expression "flavourant" refers to the ability of the botanical material to provide flavour when used in the disclosed flavour system in a tobacco industry product. As used herein, the terms "flavour" and "flavourant" refer to materials which, where local regulations permit, may be used to create a desired taste or aroma in a product for adult consumers.

The lyophilised botanical material may be any plant-derived material which when lyophilised can be activated by an activator to release a flavourant. The lyophilised botanical material is preferably derived from a plant having substantial flavourant properties. Botanical material is defined as plant-derived material in which the cellular structure of the original plant material is substantially retained. For example, plant extracts, such as a lyophilised mint extract or freeze dried instant coffee granules, are not considered to be lyophilised botanical materials.

The lyophilised botanical material may be derived from any plant parts having flavourant properties, which can be used to provide flavour to a tobacco industry product, such as, for example, to provide flavour to the smoke of a smoking article. Suitable plant parts comprise, but are not limited to, flowers, beans, fruits, leaves, stems and roots.

The selection of the lyophilised botanical material depends largely on the flavour required. Botanical material that may be used includes material obtained from botanicals such as mint (peppermint or spearmint), myrtle, clove, cassis, star anise, cumin, green cardamom, oregano, bay, fennel, thyme, ginger, sage, valerian, rosemary, pimento, mace, sage, aniseed, damien, cinnamon, tea (green or black), basil, nutmeg, coriander, marjoram, lemon grass, liquorice, olive, vanilla, paprika, saffron, lavender, coffee, and eucalyptus. For example, the lyophilised botanical material may comprise clove (*Syzygium aromaticum*), mint, or myrtle.

The lyophilised botanical material may comprise mint. The mint may be chosen from any of the following mint varieties: *Mentha Arventis, Mentha* c.v., *Mentha niliaca, Mentha piperita, Mentha piperita citrata* c.v., *Mentha piperita* c.v, *Mentha spicata crispa, Mentha cardifolia, Mentha longifolia, Mentha suaveolens variegate, Mentha pulegium, Mentha spicata* c.v. and *Mentha suaveolens*. The preferred mint variety used in accordance with the present invention is *Mentha Arventis*. The mint used may derive from a mixture of different types of mint.

Prior to lyophilisation, the botanical material may be heat treated, which may make the flavourant more susceptible to release, or may modify the flavour of the botanical material. Botanical material that may benefit from heat treatment includes material obtained from botanicals such clove, bay, ginger, mace, aniseed, and nutmeg.

Botanical material for use in the disclosed flavour system may be lyophilised by any suitable method. Lyophilisation is a dehydration process that is also known as freeze drying or cryodesiccation. Specifically, lyophilisation is a dehydration process in which material is frozen and then subjected to a reduced pressure which causes the frozen water in the material to sublimate. The present inventors have surprisingly found that in comparison to other drying procedures, lyophilisation of the botanical material does not significantly reduce the level or quality of the flavourant in the botanical material, or provided by the botanical material is used in a tobacco industry product. In particular, in comparison to botanical materials dried using alternative methods, such as methods involving heating the botanical material, volatile flavourant compounds in the botanical material have been found to preserved in the material in much greater concentrations when the material is lyophilised. As a result, botanical material that has been lyophilised yields a significantly greater level of flavourant when contacted by an activator than is possible when the botanical material has been dried by other methods. Lyophilised botanical material is, therefore, able to provide a surprising and advantageously high level of flavourant when used in a tobacco industry product.

Preferably, the water content of the lyophilised botanical material is less than 10%, 7%, 5%, 4%, 3%, 2%, or 1%.

The lyophilised botanical material may be included in the tobacco industry product flavour system in any suitable form. For example, the lyophilised material may be in the form of particles, fibres, sheets, and may, for example, be bound to a substrate.

Preferably, the lyophilised botanical material is in particulate form. If necessary, any suitable method may be used to reduce the size of the lyophilised botanical material. For example, the particles of lyophilised botanical material may be prepared to the desired size by crushing, grinding, or chopping the lyophilised material.

The disclosed flavour system for use a tobacco industry product may comprise a filter which incorporates the particulate lyophilised botanical material. For example, a filter for a tobacco industry product may include lyophilised botanical material in the form of a Dalmatian filter. In this case, the botanical material may be lyophilised and then crushed, ground, or otherwise reduced in size to a size suitable to be embedded or inserted into filter material such as cellulose acetate tow.

When used in a filter such as a Dalmatian filter, the particles of lyophilised botanical material should not be of a sufficiently small size to allow the possibility that they may be drawn out of the filter material and inhaled by the user. The lyophilised botanical material should not be harmful if inhaled, but inhaling fragments would nevertheless be unpleasant for the user of the tobacco industry product. Thus, when the lyophilised botanical material is used in particulate form, the particles should have a minimum size dictated by the nature of the tobacco industry product with which they are to be used. For example, in the case of a smoking article such as that shown in FIG. 1, the density of the filter material of both the flavour system filter section and mouth end filter sections may determine the minimum particle size that may be used. Generally, the particles of lyophilised botanical material may be larger than about 100 μm, such as larger than about 150 μm, 200 μm, 250 μm, 300 μm, 350 μm, 400 μm, 450 μm, or 500 μm.

For use in the disclosed flavour system, particles of lyophilised botanical material may be adhered to a substrate such as filter material, and this may be by suitable means of adhesion.

On the other hand, if the particles of lyophilised botanical material are excessively large, then the resulting small surface area to volume ratio of the particles may affect the capacity of the activator to sufficiently and quickly release flavourant from the botanical material. The capacity of the botanical material to impart sufficient flavour may also be detrimentally affected by the use of excessively large particles. For example, in the case of tobacco industry products in which smoke, vapour, or other gas is drawn through or across the disclosed flavour system, excessively large particles may not be capable of imparting sufficient flavour into the gas flow.

Generally, the particles of dried botanical material may be smaller than about 2000 μm, such as smaller than about 1500 μm, 1400 μm, 1300 μm, 1200 μm, 1100 μm, 1000 μm, 900 μm, or 800 μm.

Activator

The activator held within the activator release component may be any substance capable of releasing flavourant from lyophilised botanical material. Suitable activators are dependent upon the nature of the lyophilised botanical material. The activator, lyophilised botanical material, and tobacco industry product should be selected in a specific combination in which the activator is capable of releasing flavourant from the lyophilised botanical material, and the release of flavourant occurs sufficiently rapidly and to a sufficient extent to provide adequate flavour for use in the selected tobacco industry product.

The activator may have any physical form, and may, for example, be a liquid, a gas, or a solid such as a powder, or the activator may have a more complex physical form, such as a colloid, a gel, an emulsion, or a suspension. In some embodiments, the activator is a liquid, such as water or a solvent, which may be an organic solvent that has been approved for use in tobacco industry products. The activator may be any substance, such as any liquid, which has been approved for use in a tobacco industry product, and is capable of releasing flavourant from lyophilised botanical material.

In some embodiments, the activator may be a flavourant such as menthol. Preferably, however, the activator has no inherent flavour and is not a flavourant. For example, the activator may be a flavourless liquid, such as water, glycerol, a flavourless solvent, or a flavourless oil, that has been approved for use in a tobacco industry product.

In addition to the presence of lyophilised botanical material in the flavour system, in some embodiments, the activator may be a liquid within which particles of botanical material are suspended. For example, the activator release component may contain a slurry comprising activator in the form of liquid, such as an inherently flavourless liquid, and particles of botanical material. In what may be a significant period of time between the manufacture and use of the flavour system, a substantial level of flavourant may diffuse from the particles of botanical material into the liquid activator. Thus, even in embodiments in which the activator is an inherently flavourless liquid, flavourant from the botanical material may be imparted to the activator, and may in use contribute to the flavour provided by the flavour system. Even in this case, however, the activator is still considered to be inherently flavourless. Diffusion of flavourant from the particles of botanical material in the activator release component to a liquid activator may be particularly apparent in embodiments in which the activator is water or another solvent, such as a flavourless organic solvent. The botanical material in the activator release component may be selected so that its flavour is the same as, or compliments, that of the lyophilised botanical material with which the activator release component is to be used. Even in embodiments in which the particles of botanical material were lyophilised prior to incorporation into the activator release component, additional lyophilised botanical material is included in the flavour system.

The lyophilised botanical material is in a lyophilised condition at the time of actuation of the flavour system and at the time of contact between the activator and the lyophilised botanical material. If this were not the case, the activator would not be capable of either contacting lyophilised botanical material or releasing flavourant from lyophilised botanical material.

Activator Release Component

The activator release component holds or stores a payload of activator, and thus the terms "release component" and "activator release component" may be used interchangeably. Upon actuation of the activator release component, for example upon receipt of a compressive force, at least a portion of the payload of activator is released from the activator release component. Thus, an activator release component is anything that is capable of retaining activator, and releasing it as and when the user desires. For example, an activator release component may be a capsule or other component, and may comprise a sponge-like material, an adsorbent material, a gel material, or any other suitable material.

Various means of encapsulating substances, particularly liquids, for release in tobacco industry products, such as smoking article filters, are known, and are generally suitable for use in the invention. A number of different activator release components may be suitable for use in the filter. The only requirement is that a sufficient quantity of the activator can be retained by the activator release component until such time that the activator is selectively released by the user.

The activator release component may be a capsule that exhibits brittleness under stress and/or comprises a line of weakness, such as a scored line, a brittle point, or a weak section. Alternatively, a piercing means may be incorporated within the tobacco industry product flavour system. For example, the activator release component may comprise an integral piercing or rupturing means, or the activator release component may be contained within a carrier that is arranged to rupture the activator release component when required.

The activator release component may comprise a shell constructed from a frangible material. Lines or points of weakness may be provided within the encapsulating layer structure of the activator release component to assist rupture. Activator release components comprising two different materials may be used, wherein one of the materials is inherently more susceptible to rupture than the other. In this case, the less resilient material may form a zone or window, at which point the activator release component ruptures in response to force, and through which the activator may be released, providing the additional advantage of predictable directional release. The manner in which the activator release component is formed may also be used to assist rupture, for example, in a multipart activator release component, comprising a number of sections joined at one or more seams, the activator release component may be constructed to rupture along a seam section.

The activator release component may be a multiple release component, configured to release a plurality of discrete deliveries of activator. In this case, actuation of the activator release component, for example upon receipt of a compressive force, causes at most a portion of the payload of activator to be released from the activator release component. Further actuations of the activator release component provide release of further portions of the payload, providing a plurality of discrete deliveries.

In a one example of a multiple release component that may be used in the disclosed flavour system, the activator release component comprises an outer shell which is resiliently deformable. The outer shell functions as a single part, wherein the material of the outer shell is deformable. The outer shell may be formed from one part, or two (or more) parts sealed together. Preferably an outer shell formed from two parts is configured to rupture at a weakened region, for example along a longitudinal or circumferential seam joining the two parts, which opens under pressure to define a slit. The outer shell contains the activator, which is preferably a liquid such as water or another flavourless solvent, in an inner volume. The outer shell surrounds and encapsulates the activator, and does not initially contain an aperture.

Regardless of the number of parts from which it is made, the outer shell may be configured to rupture in a predetermined area, over only part of the surface area, and preferably rupture to form one or more slits or apertures, when compressed. Preferably, the outer shell defines a single slit or a line of weakening that opens under pressure to form a single slit. The activator release component is configured to release only a portion of the contained volume of activator through the slit when the activator release component is compressed. The resiliently deformable activator release component at least partially returns towards its original shape, when the compression of the activator release component ceases. After the compression has finished, the slit defined by the activator release component effectively closes, and no further contents are released from the activator release component. On a further compression, the activator release component deforms (in the same way as the initial deformation) such that the resilient slit opens, and a further discrete delivery of the contents is released.

In a second example of a multiple release component that may be used in the disclosed flavour system, the activator release component comprises an outer shell which is frangible. The outer shell is preferably configured to break apart over substantially the whole surface of the outer shell, or alternatively rupture only in a predefined area when compressed. The outer shell surrounds the activator, and does not initially contain an aperture. The outer shell contains the activator, which is preferably a liquid such as water or another flavourless solvent, in a substrate or retaining structure within the outer shell. The substrate or retaining structure is preferably a body of absorbent material impregnated with the activator. The substrate may be a porous matrix with an open structure, such as an open cell foam structure, or other type of matrix with an open cell structure. The substrate or retaining structure is configured to be progressively compressible and configured to release at least a part, and preferably only a part, of the activator contents when partly compressed. The activator is distributed within the substrate or retaining structure, and preferably, absorbed by the substrate or retaining structure.

In some embodiments, the substrate or retaining structure is preferably formed of a filtration material, for example, cellulose acetate. The filtration material may be in the form of a tow of filtration material suitable as a filter. The outer shell does not inhibit release of the activator once ruptured. The substrate or retaining structure may be at least partially resiliently deformable and may at least partially return towards original shape, when the compression of the activator release component ceases. On a further partial compression, the substrate releases a further discrete delivery of the contents.

In a third example of a multiple release component that may be used in the disclosed flavour system, the activator release component comprises a matrix with a closed cell structure, in particular, a closed cell foam substrate or any other type of matrix or structure with a closed cell configuration. The closed cell structure defines a matrix having a plurality of small cavities which contain activator. The cavities are closed by the foam or support material, retaining the activator until selective release. On application of a compressive force, the closed cell structure is configured to release activator. The compressed closed cell structure develops cracks and/or openings in the support material, which allow release of the activator. The activator release component is configured to release only a part of the contents when partially compressed. The structure preferably substantially plastically deforms on compression. Alternatively, the substrate may partially return towards its original dimensions.

The closed cell structure does not require an outer shell to retain the activator, and so may form the activator release component without an outer shell. Alternatively, the activator release component may comprise the closed cell substrate encapsulated in an outer shell. The outer shell may be frangible, plastically deformable or resiliently deformable on compression.

The closed cell structure may be formed by extrusion of the material containing the activator. The extruded closed cell structure is then cut to a suitable length. The closed cell structure may be made from cellulose acetate. The open or closed cell structure may contain a plurality of activator release components, each comprising encapsulated activator.

Alternatively, the substrate may be fibrous, e.g. formed of cellulose acetate fibres, with activator dispersed therein as droplets or as microcapsules. The droplets or microcapsules are preferably distributed within the matrix or fibres. The microcapsules are preferably attached to the one or more threads or fibres, which are formed or arranged into a three-dimensional substrate. The substrate is optionally surrounded by a frangible, elastically deformable or plastically deformable outer shell. The substrate is preferably configured such that the activator can be released in a plurality of discrete deliveries, preferably by a plurality of separate compressions. This differs from a conventional capsule having a frangible outer shell, in which all the activator is released at once when the outer shell is ruptured.

Any type of multiple or single activator release component for use in the filter may comprise a substrate within the outer shell. The activator is distributed within the substrate. The substrate is preferably an open cell foam material or open cell structure, which is compressible and configured to release all or a portion of the activator contents when compressed. The substrate is preferably formed of a filtration material, for example, cellulose acetate tow. The substrate may be resiliently deformable, contained within a plastically deformable outer wall but is prevented from returning to its original shape by the outer wall when compression ceases. Alternatively, the open cell structure may actuate or follow a resilient outer wall at least partially towards its original shape when compression ceases. Alternatively, the open cell foam substrate or structure may not resiliently return towards to its original size, and may plastically deform when compressed.

The outer wall or shell or any type of activator release component may be configured as a structural part, which provides strength to allow handling of the activator release component. For example, the outer wall or shell may have a thickness of approximately 0.2 mm. Alternatively, the outer wall or shell may be a coating on the exterior of the substrate, which does not provide structural strength.

The activator release component may be arranged to release activator directionally towards a particular region of the flavour system, which may be a region of the flavour system comprising lyophilised botanical material.

The target region of directional activator release may be, for example, a cavity within the flavour system, which may comprise lyophilised botanical material. In another example, the particular region to which activator is directed may be a region of filter material comprising lyophilised botanical material.

The activator release component may be a capsule composed of a low solubility, high molecular weight polyvinyl alcohol. A number of suitable alternative materials are known, and by way of example, capsules typically utilized in the pharmaceutical industry may be used as activator release components.

In some embodiments, activator release components may be composed of a gelatin based material, or may be formed from a polymeric material, such as modified cellulose. One type of modified cellulose which may be used is hydroxypropylmethyl cellulose. Many biodegradable materials are known which may be suitable for use in the production of activator release components and these include high molecular weight polyethylene glycols, polylactic acid, plastarch material, polycaprolactone, polyglycolide, a polyhydroxyalkanoate such as poly-3-hydroxybutyrate, and zein-derived bioplastics.

The activator release component may alternatively be comprised of a wax, resin, natural or synthetic gum, latex or plastic material which cracks or breaks in response to the application of force by the user to release the activator contents to contact lyophilised botanical material and release flavourant from the botanical material. Examples of suitable waxes include beeswax, candelilla, carnauba, Shellac wax, caranday, sugarcane wax, myrtle wax and petroleum wax. Suitable resins include epoxy resins, terpene resins, petroleum resins, ester gum, phenolic resins and rosin based resins. Preferred gums include gum arabic, locust bean, guar, alginates, carrageenan and pectin.

When the activator release component comprises a closed cell structure, any suitable sponge-like material may be used. The sponge material may be a foamed material, which may be a foamed plastic polymer such as Polyvinyl alcohol (PVOH). The sponge-like or gel-like material may be coated in a second material, which may form an outer shell encompassing the sponge-like or gel-like material.

The activator release component may be formed in a variety of physical arrangements including singular part or multipart, large (occupying a substantial proportion of the diameter of the filter), small, in the form of a plurality of microcapsules, etc. The activator release component may be generally spherical, ovoid, ellipsoidal, cylindrical, or may approximate to a polygonal prism in shape.

The activator release component may be coloured. For example, the activator release component may comprise a colouring agent. The colouring agent may be used to render more easily the location of the activator release component within the filter during the manufacturing process.

The size of the activator release component is, at least in part, dependent on the amount of activator required. Consideration must be given to the fact that the presence of the activator release component in the flavour system must not have an adverse effect on the functioning of the flavour system. For example, when the flavour system is for use in smoking article, such as a smoking article filter, the flavour system should not have a detrimental effect on the draw characteristics of the smoking article.

The size of the activator release component is also largely dependent on the nature of the tobacco industry product with which the disclosed flavour system is to be used. When the tobacco industry product is a smoking article the diameter of the activator release component may be up to 80% of the diameter of the smoking article. Preferably the diameter is up to 70%, up to 60%, or up to 50% of the diameter of the smoking article. The diameter of the activator release component may be 20-80%, 25-75%, 30-70%, 35-65%, or 40-60% of the diameter of the smoking article. Generally, the diameter of the activator release component may be within the range 1-6 mm, 2-5 mm, or 3-4 mm. For example, the diameter of the activator release component may be between 2 and 7 mm, and preferably the diameter is between 4 and 6 mm, such as 5 mm.

It may be preferable for the volume of the activator release component to be as large as possible to contact as much lyophilised botanical material as possible to release as much flavourant as possible from the botanical material.

However, the size of the activator release component limited by factors including, for example, the operation of the flavour system, and, in the case of frangible activator release components, the risk of premature rupture of the activator release component is also increased. Consequently, to accommodate the required amount of activator, it may be preferable for the disclosed flavour system to comprise two, three, four or more activator release components, rather than one activator release component with the same total volume. For example, when the tobacco industry product is a smoking article, multiple activator release components may be positioned at regularly spaced intervals, or in a randomly distributed, along the length of the smoking article filter. Alternatively, multiple activator release components may be provided in a cluster within the disclosed flavour system, for example in the case of a smoking article, within a cavity formed between two sections of filter material.

In some embodiments, long cylindrical or ellipsoidal (or tubular) activator release components may be used, depending on the nature of the tobacco industry product. For example, when the tobacco industry product is a smoking article such as those shown in FIGS. 1-3, an activator release component having a length equal to a significant proportion of the length of the smoking article filter, may be used. Such activator release components may be up to 5 mm in diameter.

The activator release component may be manufactured using any suitable method, the method of manufacture of the activator release component being in part dependent on the precise composition and make-up required. Various methods of manufacture will be known to the skilled person, including techniques such as co-extrusion, spin coating, coacervation, interfacial polymerization, solvent evaporation, and annular jet forming.

In some embodiments in which the activator release component comprises a seamless capsule, and particularly where the activator comprises a liquid, the capsule may be produced using a co-extrusion process. The co-extrusion process is a synchronous extrusion of the two liquids that will subsequently form the shell and the capsule contents (activator). The first (co-extrusion) step involves forming a droplet having the liquid activator material inside the liquid shell material. After the co-extrusion step, the "capsule" is solidified by cooling or by immersion in a curing agent, for example. The capsules may then be subjected to various treatments, such as washing, removal of surplus liquid, colouring, application of additional coatings, etc.

Alternatively, an annular jet forming technique may be used. This method utilises two concentric jets to eject an inner jet of core material (activator) and an outer jet of liquid shell material. The fluid stream breaks into droplets and the liquid shell material solidifies by phase transition induced by the presence of cross-linking ions, pH differences, temperature changes, etc.

Tobacco Industry Product

As used herein, the term "tobacco industry product" is to be understood as including smoking articles comprising combustible smoking articles such as cigarettes, cigarillos, cigars, tobacco for pipes or for roll-your-own cigarettes, (whether based on tobacco, tobacco derivatives, expanded tobacco, reconstituted tobacco, tobacco substitutes or other smokable material), electronic smoking articles such as e-cigarettes, heating devices that release compounds from substrate materials without burning such as tobacco heating products; and hybrid systems to generate aerosol from a combination of substrate materials, for example hybrid systems containing a liquid or gel or solid substrate. The disclosed flavour system may be included in any tobacco industry product. For example, the flavour system may be included in the mouthpiece of the tobacco industry product, such as the filter of a smoking article.

In one embodiment, the tobacco industry product is a smoking article for combustion selected from the group consisting of a cigarette, a cigarillo and a cigar.

In one embodiment, the tobacco industry product is a non-combustible smoking article.

In one embodiment the tobacco industry product is a heating device which releases compounds by heating, but not burning, a substrate material. The material may be for example tobacco or other non-tobacco products, which may or may not contain nicotine. In one embodiment the heating device is a tobacco heating device. In some embodiments, the flavour system may be included in the mouthpiece of such a heating device, to provide flavourant to the compounds released by heating, but not burning, a substrate material. In some embodiments, the flavour system may be included in the substrate material to be heated. Heating may cause or assist the release of activator from the activator release component. In addition, or alternatively, heating may increase the level or rate of flavourant released from the lyophilised botanical material by the activator.

In another embodiment the tobacco industry product is a hybrid system to generate aerosol by heating, but not burning, a combination of substrate materials. The substrate materials may comprise for example solid, liquid or gel which may or may not contain nicotine. In one embodiment, the hybrid system comprises a liquid or gel substrate and a solid substrate. The solid substrate may be for example tobacco or other non-tobacco products, which may or may not contain nicotine, In one embodiment, the hybrid system comprises a liquid or gel substrate and tobacco. In some embodiments, the flavour system may be included in the mouthpiece of such a hybrid system, to provide flavourant to the generated aerosol. In some embodiments, the flavour system may be included in the combination of substrate materials to be heated. Heating may cause or assist the release of activator from the activator release component. In addition, or alternatively, heating may increase the level or rate of flavourant released from the lyophilised botanical material by the activator.

The tobacco industry product may comprise a filter or filter section which may be or may comprise the disclosed flavour system.

The filter or filter section may include filter material. The filter material may comprise, lo or consist of, any suitable material that is capable of filtering a gaseous flow, such as, for example, fibrous cellulose acetate, polypropylene or polyethylene material or gathered paper material.

The lyophilised botanical material may be incorporated into the filter material of the flavour system. For example, the flavour system may be, or may comprise, a multi-section filter, and one or more of the filter sections may include lyophilised botanical material. The lyophilised botanical material can be incorporated into a filter, such as a filter rod, using various techniques. For example, the lyophilised botanical material may be in particulate form, and the particles may be contained within a cavity in the filter rod or applied on and/or distributed within the filter material. A Dalmatian filter section may be prepared by uniformly sprinkling a suitable quantity of particulate lyophilised botanical material on a tow traveling laterally on a mechanical support. The tow used for the preparation of such a filter section is a laterally widened tow and sprinkling of the particles is effected through passage of the tow at a specific speed under an apparatus distributing the particles. In a similar process, one or more activator release components may also be incorporated into the tow at this stage. The tow may then be formed into a thin rod-shaped bundle, coated with plugwrap and cut into rods of predetermined size.

Filters can also be configured as a combination of sections of various filter materials, physical forms and/or composition wherein one or more of the filter sections may be, or may comprise, a flavour system as disclosed. For example, filter rods may comprise two, three, four, or more, any two of which may have the same or different constructions, and wherein at least one of the filter sections may be, or may comprise, a flavour system of the present disclosure. The filter sections may be maintained together using a plugwrap. Such multi-section filter construction can provide various advantages in terms of general appearance and resistance to draw. The filters may be symmetrical, when the sections are all of the same size, or asymmetrical, when two or more of the sections are of different lengths. Multi-section filters may comprise one or more cavities between the sections. The filter may also be prepared by filling a cavity between two sections of filter material, and in this case, lyophilised botanical material and/or one or more activator release components may be present in one or more cavities between two filter sections.

The various embodiments described herein are presented only to assist in understanding and teaching the claimed features. These embodiments are provided as a representative sample of embodiments only, and are not exhaustive and/or exclusive. It is to be understood that advantages, embodiments, examples, functions, features, structures, and/or other aspects described herein are not to be considered limitations on the scope of the invention as defined by the claims or limitations on equivalents to the claims, and that other embodiments may be utilised and modifications may be made without departing from the scope of the claimed invention. Various embodiments of the invention may suitably comprise, consist of, or consist essentially of, appropriate combinations of the disclosed elements, components, features, parts, steps, means, etc, other than those specifically described herein. In addition, this disclosure may include other inventions not presently claimed, but which may be claimed in future.

The invention claimed is:

1. A flavour system for use in a tobacco industry product, wherein the tobacco industry product is a product through which gaseous flow may be drawn, the flavour system comprising:

lyophilised botanical material, an activator capable of releasing flavourant from the lyophilised botanical material through contact of the activator with the lyophilised botanical material, and a removable barrier preventing contact between the lyophilised botanical material and the activator, wherein the barrier is removable to permit the activator to contact the lyophilised botanical material, thereby to cause release of the flavourant from the lyophilised botanical material, wherein the flavourant is releasable to be entrained in a gaseous flow drawn by a user through the tobacco industry product,.

wherein the lyophilised botanical material comprises particles of a lyophilised plant material having a multicellular structure, wherein the activator is configured to release flavourant from the lyophilised botanical material by rehydrating the lyophilised botanical material, and wherein the activator is contained within a rupturable activator release component, and the lyophilised botanical material is outside the activator release component.

2. A flavour system as claimed in claim 1, wherein the activator release component is a frangible capsule.

3. A flavour system as claimed in claim 1, wherein the activator comprises a liquid.

4. A flavour system as claimed in claim 1, wherein the activator is an inherently flavourless liquid.

5. A flavour system as claimed in claim 1, wherein the activator comprises or consists of water or an organic solvent.

6. A flavour system as claimed in claim 1, wherein the flavour system comprises a filter section for use in a smoking article, and wherein, flavourant is releasable from the lyophilised botanical material to be entrained in smoke that is drawn through the filter section.

7. A flavour system as claimed in claim 6, wherein the filter section comprises filter material, and wherein the lyophilised botanical material is particulate and is distributed throughout the filter material.

8. A flavour system as claimed in claim 7, wherein the activator is contained within an activator release component within the filter material, and wherein, the activator is releasable from the activator release component to contact the lyophilised botanical material within the filter material.

9. A flavour system as claimed in claim 1, wherein the lyophilised botanical material comprises clove, mint, or myrtle.

10. A filter for a smoking article comprising a flavour system as claimed in claim 1.

11. A smoking article comprising a flavour system as claimed in claim 1.

12. A method for forming a tobacco industry product comprising a flavour system, wherein the tobacco industry product is a product through which gaseous flow may be drawn, the method comprising:

i) providing a flavour system including lyophilised botanical material, an activator capable of releasing flavourant from the lyophilised botanical material, and a removable barrier preventing contact between the lyophilised botanical material and the activator, wherein the barrier is rupturable to permit the activator to contact the lyophilised botanical material, thereby to cause release of the flavourant from the lyophilised botanical material, wherein the flavourant is releasable to be entrained in a gaseous flow drawn by a user through the tobacco industry product, wherein the lyophilised botanical material comprises particles of a lyophilised plant material having a multicellular structure, wherein the activator is configured to release flavourant from the lyophilised botanical material by rehydrating the lyophilised botanical material, and wherein the activator is contained within a rupturable activator release component, and the lyophilised botanical material is outside the activator release component; and ii) including the flavour system in a tobacco industry product such that in use the released flavourant may be entrained in a gaseous flow drawn by a user through the tobacco industry product.

13. A method for forming a smoking article filter section comprising a flavour system, the method comprising:

i) providing lyophilised botanical material, wherein the lyophilised botanical material comprises particles of a lyophilised plant material having a multicellular structure;

ii) providing an activator release component comprising an activator capable of releasing flavourant from the lyophilised botanical material and a removable barrier preventing contact between the lyophilised botanical material and the activator, wherein the barrier is rupturable to permit the activator to contact the lyophilised botanical material, thereby to cause release of the flavourant from the lyophilised botanical material, wherein the flavourant is releasable to be entrained in a gaseous flow drawn by a user through the tobacco industry product, wherein the activator is configured to release flavourant from the lyophilised botanical material by rehydrating the lyophilised botanical material, and wherein the activator is contained within a rupturable activator release component, and the lyophilised botanical material is outside the activator release component; and iii) incorporating the lyophilised botanical material and activator release component into a filter section.

* * * * *